US007187779B2

(12) United States Patent
Usuki et al.

(10) Patent No.: US 7,187,779 B2
(45) Date of Patent: Mar. 6, 2007

(54) ELECTROMAGNETIC TRANSDUCER AND PORTABLE COMMUNICATION DEVICE

(75) Inventors: Sawako Usuki, Hyogo (JP); Shuji Saiki, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 1219 days.

(21) Appl. No.: 09/965,966

(22) Filed: Sep. 28, 2001

(65) Prior Publication Data

US 2002/0037089 A1 Mar. 28, 2002

(30) Foreign Application Priority Data

Sep. 28, 2000 (JP) ..... 2000-296264

(51) Int. Cl.
*H04R 9/06* (2006.01)

(52) U.S. Cl. ..... 381/414; 381/412

(58) Field of Classification Search ..... 340/384.1, 340/391.1; 455/128, 347, 349, 350, 567, 455/575.1; 381/189, 391, 394, 395, 396, 381/412, 414, 423, 424, 429, 431
See application file for complete search history.

(56) References Cited

U.S. PATENT DOCUMENTS 5,467,323 A * 11/1995 Sone ..... 381/398
5,956,622 A * 9/1999 Lee ..... 381/396

FOREIGN PATENT DOCUMENTS

| | | |
|---|---|---|
| CN | 1253463 A | 5/2000 |
| EP | 0 999 722 A2 | 5/2000 |
| JP | 57-154998 | 9/1982 |
| JP | 58-171198 | 10/1983 |
| JP | 11-557794 | 2/1999 |
| WO | WO 99/39843 A1 | 8/1999 |
| WO | WO 00/32013 | 6/2000 |

OTHER PUBLICATIONS

European Search Report dated May 7, 2003.
Chinese Office Action dated Nov. 7, 2003 (5 pages).

* cited by examiner

*Primary Examiner*—Sinh Tran
*Assistant Examiner*—Brian Ensey
(74) *Attorney, Agent, or Firm*—RatnerPrestia

(57) ABSTRACT

An electromagnetic transducer includes a magnetic member, a suspension for supporting the magnetic member at a central portion of the suspension, a diaphragm connected to the suspension, a magnet for generating magnetic flux on the magnetic member, and a coil for generating alternating magnetic flux on the magnetic member.

14 Claims, 10 Drawing Sheets

ELECTROMAGNETIC TRANSDUCER AND PORTABLE COMMUNICATION DEVICE

BACKGROUND OF THE INVENTION

1. Field of the Invention

The present invention relates to an electroacoustic transducer of an electromagnetic type for use in a portable communication device, e.g., a cellular phone or a pager, for reproducing an alarm sound or melody sound responsive to a received call and for reproducing voices and the like, and a portable communication device including the electroacoustic transducer of an electromagnetic type.

2. Description of the Related Art

FIGS. 9A and 9B are plan and cross-sectional views showing a conventional electroacoustic transducer 2000 of an electromagnetic type (hereinafter referred to as an electromagnetic transducer).

The conventional electromagnetic transducer 2000 includes a cylindrical housing 107 and a disk-shaped yoke 106 disposed so as to cover the bottom face of the housing 107. A center pole 103, which forms an integral part of the yoke 106, is provided in a central portion of the yoke 106. A coil 104 is wound around the center pole 103. Spaced from the outer periphery of the coil 104 is provided an annular magnet 105, with an appropriate interspace maintained between the coil 104 and the inner periphery of the annular magnet 105 around the entire periphery of the coil 104. The outer peripheral surface of the magnet 105 is abutted to the inner peripheral surface of the housing 107. An upper end of the housing 107 supports a disk-shaped diaphragm 100 so that an appropriate interspace exists between the first diaphragm 100 and the magnet 105, the coil 104, and the center pole 103. A magnetic member 101 is provided on the diaphragm 100 so as to be concentric with the diaphragm 100.

Now, an operation of the above-described conventional electromagnetic transducer 2000 will be described.

In an initial state where no current flows through the coil 104, a magnetic path is formed by the magnet 105, the magnetic member 101, the center pole 103, and the yoke 106. As a result, the magnetic member 110 is attracted toward the magnet 105 and the center pole 103, up to a point of equilibrium with the elastic force of the diaphragm 100. If an alternating current flows through the coil 104 in this initial state, an alternating magnetic field is generated in the aforementioned magnetic path, so that a driving force is generated on the magnetic member 101. Such a driving force generated on the magnetic member 101 causes the magnetic member 101 to be displaced from its initial state, along with the fixed diaphragm 100, due to an interaction with an attraction force which is generated by the magnet 105 and the driving force. The vibration caused by such displacement transmits sound.

The lower limit of a frequency band to be reproduced by an electromagnetic transducer is generally dependent on the minimum resonance frequency of a vibrating system. A vibrating system as used herein refers to a group of elements included in an electromagnetic transducer which actually vibrate so as to produce sound. In the conventional electromagnetic transducer 2000, the minimum resonance frequency cannot be reduced to such a level that a low frequency signal, such as an audio signal, can be reproduced. The reason will be described below.

The minimum resonance frequency of the electromagnetic transducer 2000 is dependent on the stiffness of a vibrating system, which is obtained as a difference between an elastic force of the diaphragm 100 and an attraction force generated on the magnetic member 101 by the magnet 105.

FIG. 10 shows a relationship between the force-displacement characteristics curve of the diaphragm 100 and the attraction force generated on the magnetic member 101 by the magnet 105. In FIG. 10, the vertical axis represents a force while the horizontal axis represents a displacement of the diaphragm 100. An intersection A between a curve indicating the force-displacement characteristics of the diaphragm 100 and a curve indicating the attraction force generated on the magnetic member101 by the magnet105 represents a point where the elastic force of the diaphragm 100 is balanced with the attraction force. The minimum resonance frequency is dependent on a difference between the elastic force of the diaphragm 100 and the attraction force where the intersection A is regarded as an original point.

It is necessary to decrease the elastic constant of the diaphragm 100 in order to reduce the minimum resonance frequency. However, when the elastic constant of the diaphragm 100 is excessively small (i.e., no intersection A exists), the magnetic member 101 is trapped by the center pole 103 along with the diaphragm 100. Therefore, since the elastic constant must be the range in which the intersection A exists, the possible minimum resonance frequency is limited. Due to such a constraint, the minimum resonance frequency of the conventional electromagnetic transducer 2000 is typically about 2.5 kHz or more. Therefore, a low frequency signal, such as an audio signal, cannot be reproduced by the conventional electromagnetic transducer 2000.

SUMMARY OF THE INVENTION

According to one aspect of the present invention, an electromagnetic transducer includes a magnetic member, a suspension for supporting the magnetic member at a central portion of the suspension, a diaphragm connected to the suspension, a magnet for generating magnetic flux on the magnetic member, and a coil for generating alternating magnetic flux on the magnetic member.

In one embodiment of this invention, the stiffness of the suspension is greater than the stiffness of the diaphragm with respect to a vibration direction.

In one embodiment of this invention, the electromagnetic transducer further includes a center pole provided at an inner periphery side of the coil, and a yoke provided at a side of the coil opposite to the diaphragm. The magnet surrounds the coil.

In one embodiment of this invention, the diaphragm comprises a resin.

In one embodiment of this invention, the suspension comprises a metal.

In one embodiment of this invention, the suspension comprises a non-magnetic material.

In one embodiment of this invention, the electromagnetic transducer further includes a thin magnetic plate provided between the magnet and the diaphragm.

In one embodiment of this invention, an opening is provided at a central portion of the magnetic member.

In one embodiment of this invention, the electromagnetic transducer further includes a cover for covering the opening.

According to another aspect of the present invention, an electromagnetic transducer includes a magnetic member, a suspension for supporting the magnetic member at a central portion of the suspension, a diaphragm connected to the suspension, a yoke opposed to the diaphragm, a center pole provided at a diaphragm side of the yoke, a coil surrounding the center pole, and a magnet surrounding the coil. An opening is provided in each of the magnetic member and the suspension, the center pole is shaped so as to be inserted into the openings, and an upper face of the center pole is positioned higher than or equal to a bottom face of the magnet member.

In one embodiment of this invention, the suspension and the magnetic member are integrated together.

In one embodiment of this invention, an outer periphery of the diaphragm and an outer periphery of the suspension are positioned on the same plane.

According to another aspect of the present invention, a portable communication device includes the above-described electromagnetic transducer.

Thus, the invention described herein makes possible the advantages of providing (1) an electromagnetic transducer having a satisfactory acoustic characteristic capable of reproducing a low frequency signal, such as an audio signal; and (2) a portable communication terminal including the transducer.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

EXAMPLE 1

An electromagnetic transducer 1000 according to Example 1 of the present invention will be described with reference to FIGS. 1, 2 and 3.

Figure 1:
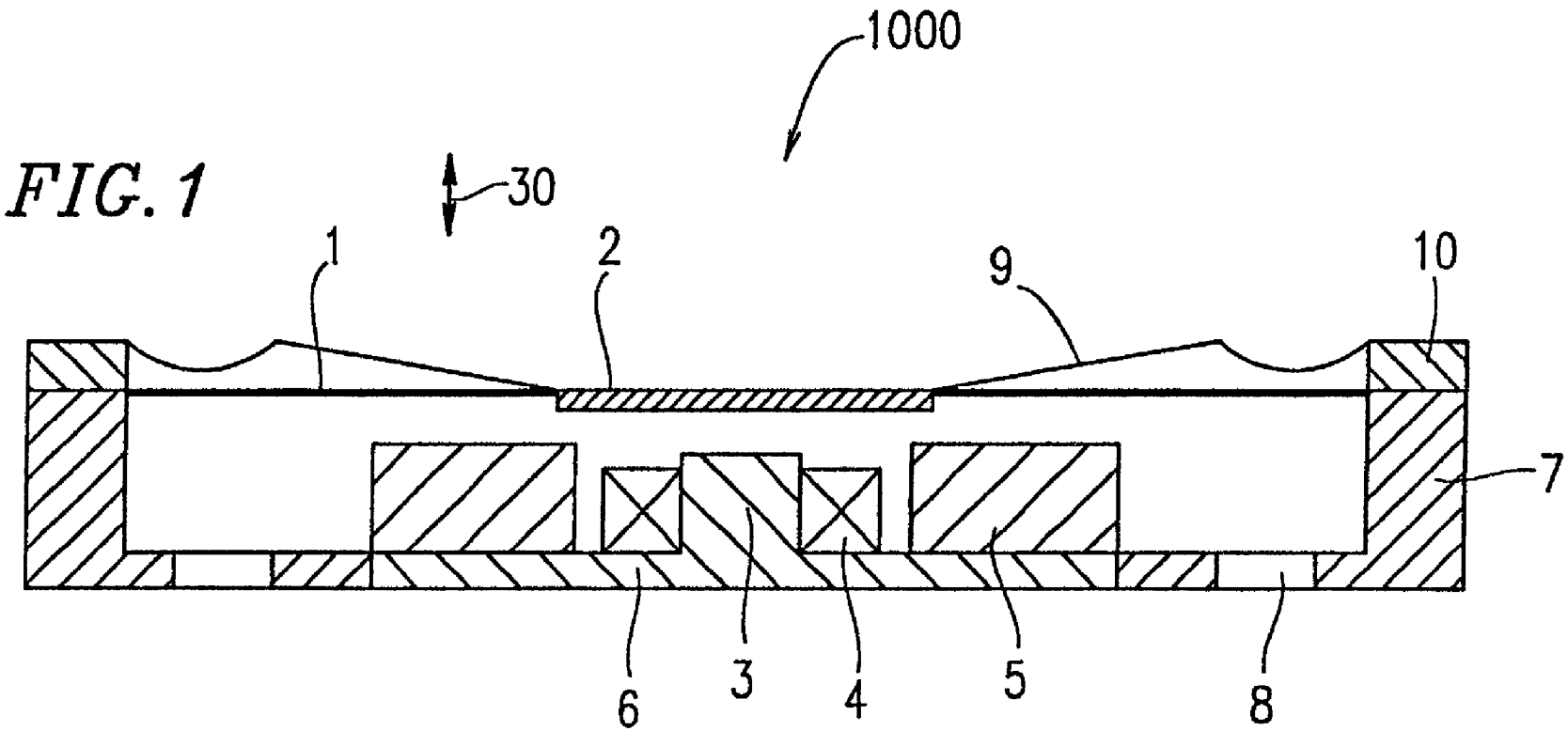
FIG. 1 is a diagram showing an electromagnetic transducer according to Example 1 of the present invention.

FIG. 1 is a cross-sectional view showing the electromagnetic transducer 1000. The electromagnetic transducer 1000 includes a disk-shaped yoke 6, a cylindrical housing 7 surrounding the disk-shaped yoke 6, a center pole 3 provided in a central portion of the yoke 6, a coil 4 wound around the center pole 3, an annular magnet 5 spaced from the outer periphery of the coil 4, a suspension 1 supported by the housing 7 in such a manner as to be able to vibrate, a magnetic member 2 provided in a central portion of the suspension 1, a cylindrical spacer 10 provided on the housing 7, and a diaphragm 9 supported by the spacer 10 in such a manner as to be able to vibrate.

The central portion of the diaphragm 9 is connected with the suspension 1. An appropriate interspace is maintained between the coil 4 and the inner periphery of the annular magnet 5 around the entire circumference thereof. Further, an appropriate interspace is maintained between the outer periphery of the magnet 5 and the inner periphery of the housing 7 around the entire circumference thereof. An appropriate interspace is maintained between the suspension 1, and the coil 4, the center pole 3 and the magnet 5. A plurality of air holes 8 for releasing out air between the diaphragm 9 and the yoke 6 are provided on the bottom face of the housing 7 so as to reduce an acoustic load on the diaphragm 9.

Figure 2:
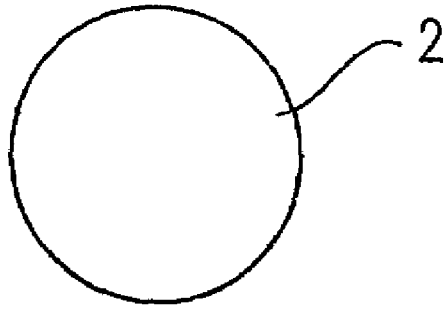
FIG. 2 is a diagram showing a magnetic member in the electromagnetic transducer of Example 1.
Figure 3:
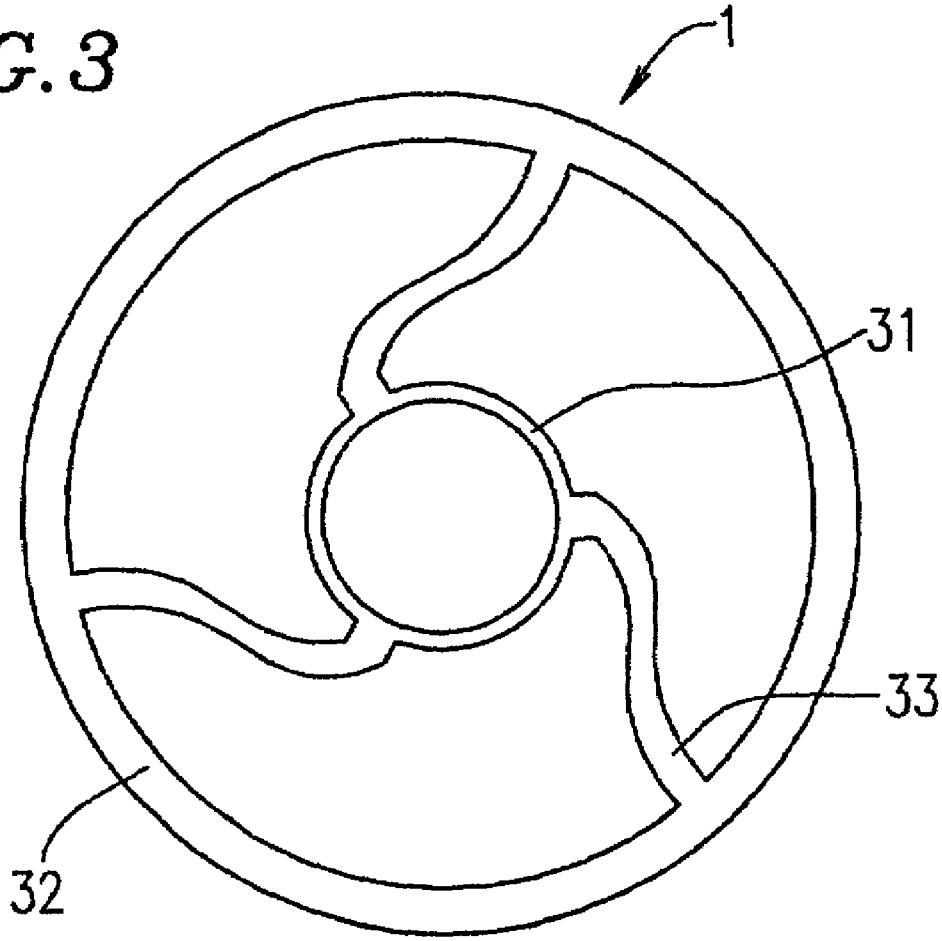
FIG. 3 is a diagram showing a suspension in the electromagnetic transducer of Example 1.

FIG. 2 is a plan view of the electromagnetic transducer 1000, showing that the magnetic member 2 is in the shape of a disk. FIG. 3 is a plan view of the suspension 1 of the electromagnetic transducer 1000. As shown in FIGS. 1 and 3, the suspension 1 includes a central portion 31 at which a magnetic member 2 is provided, an outer periphery portion 32 supported by the housing 7, and a plurality of radial portions 33 connecting between the central portion 31 and the outer periphery portion 32. As shown in FIG. 1, the diaphragm 9 is in the shape of a cone having a downroll-shaped periphery. The stiffness in a vibration direction 30 of the suspension 1 is greater than the stiffness in the vibration direction 30 of the diaphragm 9.

In Example 1, materials for the suspension 1, the magnetic member 2, and the diaphragm 9 are stainless steel, permalloy, and PEN (Poly Ethylene Naphthalate), respectively.

An operation of the aforementioned electromagnetic transducer 1000 will be described below.

In an initial state where no current flows through the coil 4, a magnetic path is formed by the magnet 5, the magnetic member 2, the center pole 3, and the yoke 6. Due to this magnetic path, a downward attraction force is exerted on the magnetic member 2, so that the suspension 1 is displaced downward along with the magnetic member 2. In addition, the diaphragm 9 connected to the suspension 1 is displaced downward. In this case, when an alternating current flows through the coil 4 and an alternating magnetic field is therefore generated, a driving force is generated on the magnetic member 2. This driving force causes the magnetic member 2 as well as the suspension 1 and the diaphragm 9 to be displaced from the initial state. The vibration caused by such displacement of the diaphragm 9 transmits sound.

In the electromagnetic transducer 1000, the stiffness in the vibration direction 30 of the suspension 1 is greater than the stiffness in the vibration direction 30 of the diaphragm 9. For example, the electromagnetic transducer 1000 is designed so that the stiffness in the vibration direction 30 of the suspension 1 is seven times greater than the stiffness in the vibration direction 30 of the diaphragm 9. Since the stiffness of the suspension 1 is greater, the magnetic member 2 on which the attraction force is always exerted is substantially supported by the suspension 1. As is different from the conventional electromagnetic transducer 2000, the diaphragm 9 does not need to support the magnetic member 2.

Therefore, the shape of the diaphragm 9 can be designed without taking into consideration the support of the magnetic member 2 by the diaphragm 9. As a result, the stiffness of the diaphragm 9 is substantially not great when the diaphragm 9 is largely vibrated, as compared to conventional diaphragms. Therefore, the minimum resonance frequency can be reduced (e.g., 700 to 800 Hz), thereby making it possible to reproduce a low frequency signal, such as an audio signal.

Further, when the diameter of the diaphragm 9 is, for example, 15 mm, the effective radius of the diaphragm 9 within which the diaphragm 9 is actually vibrated can be increased by 10% or more as compared to when the diaphragm 9 is designed while taking into consideration the support of the magnetic member 2 by the diaphragm 9. Therefore, a sound pressure in reproduction can be improved.

In the electromagnetic transducer 1000, the suspension 1 does not need to play a role in making a sound, so the suspension 1 is designed only with the support of the magnetic member 2 taken into consideration. Therefore, the suspension 1 can be realized using a flat plate as shown in FIG. 3, so that components can be more precisely fabricated as compared to when a diaphragm is formed so as to support a magnetic member as in conventional electromagnetic transducers, resulting in a reduction in variation in the performance of a product. Since the elastic force of the suspension 1 is designed to be greater than the attraction force, the magnetic member 2 is not trapped by the center pole 3 even when the elastic force of the diaphragm 9 is small.

A metal material for the suspension 1, such as stainless steel, substantially does not change over time due to the attraction force which is always exerted on the magnetic member 2. When a metal material, such as stainless steel, is used for the suspension 1 which substantially supports the magnetic member 2, an electromagnetic transducer having a durability which substantially does not change over time can be achieved.

Further, when the suspension 1 is made of a non-magnetic or weak-magnetic material, the suspension 1 is substantially not influenced by the attraction force of the magnet 5. Therefore, in this case, the shape of the suspension 1 can be more easily designed.

Since the diaphragm 9 does not need to support the magnetic member 2, the design of the shape of the diaphragm 9 for a desired acoustic characteristic is easy. As described above, it is possible to reduce a change in the stiffness of the diaphragm 9 depending on the amplitude, so that a low frequency signal, such as an audio signal, can be reproduced. In addition, distortion of the diaphragm 9 can be reduced. Further, the flatness of an amplitude characteristic of the diaphragm 9 with respect to an input voltage can be improved. Thus, the diaphragm 9 can be freely designed so as to obtain a satisfactory acoustic characteristic. A resin material, such as PEN, is easy to process and shape. Therefore, when the diaphragm 9 is made of a resin material, such as PEN, it is easy to design the diaphragm 9 to have a satisfactory acoustic characteristic.

In Example 1, the suspension 1 is made of stainless steel and the diaphragm 9 is made of PEN. The present invention is not limited to this. For example, if heat resistance is taken into consideration, the suspension 1 and the diaphragm 9 may be made of a metal material for both, or a metal material and a heat-resistance resin material, respectively. Alternatively, although the suspension 1 is made of a non-magnetic material, a magnetic material may be used to enhance the driving force. Further, the suspension 1 may be made of permalloy, which is the same material as that of the magnetic member 2, in terms of an interface therebetween.

In Example 1, the suspension 1 has three arms extending in a radial direction. The suspension 1 may be in the shape of a butterfly or other shapes. Further, although the diaphragm 9 is in the shape of a cone, the diaphragm 9 may be in the shape of a dome or other shapes.

EXAMPLE 2

An electromagnetic transducer 1100 according to Example 2 of the present invention will be described with reference to FIGS. 4 and 5.

Figure 4:
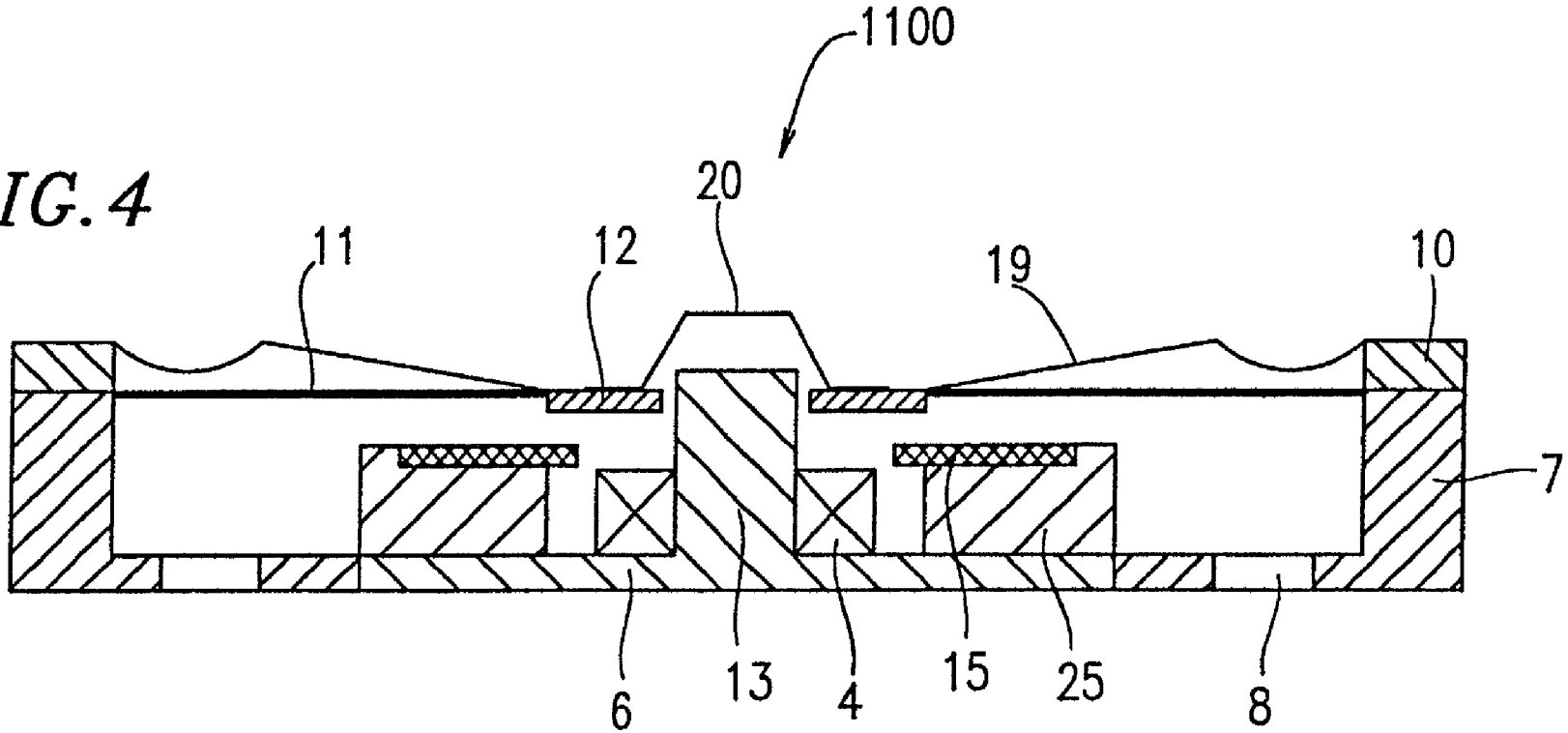
FIG. 4 is a diagram showing an electromagnetic transducer according to Example 2 of the present invention.

FIG. 4 is a cross-sectional view showing the electromagnetic transducer 1100. The electromagnetic transducer 1100 includes a coil 4, a yoke 6, a housing 7, an air hole 8 and a spacer 10 which are the same as those of the electromagnetic transducer 1000 of FIG. 1.

Figure 5A:
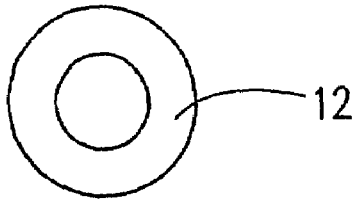
FIGS. 5A to 5C are diagrams showing a magnetic member, a suspension and a diaphragm in the electromagnetic transducer of Example 2, respectively.
Figure 5B:
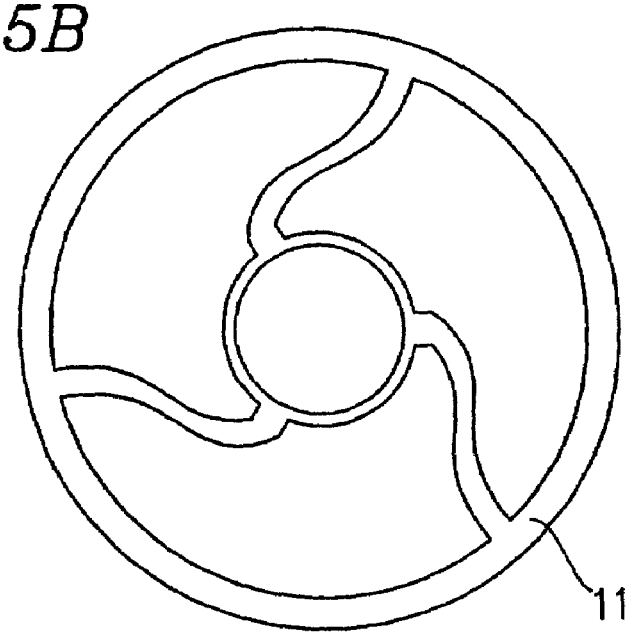
Figure 5C:
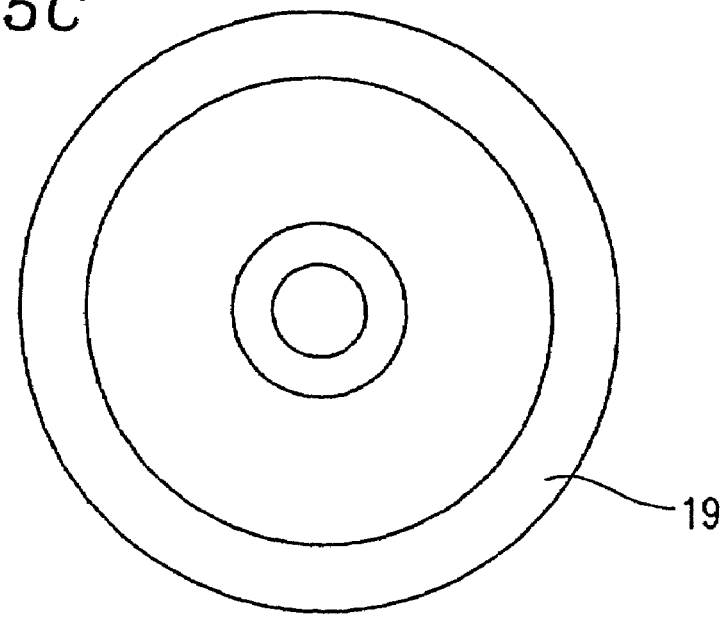

FIGS. 5A, 5B and 5C are plan views of elements of the electromagnetic transducer 1100. As shown in these figures, the electromagnetic transducer 1100 further includes a annular magnetic member 12 having an opening provided in a central portion thereof, a suspension 11, a diaphragm 19, a center pole 13 having a shape which enables the center pole 13 to be inserted into the opening, a cover 20 covering the opening, a magnet 25 having a hollow portion, and a thin magnetic plate 15 provided in the hollow portion of the magnet 25. The upper face of the center pole 13 is positioned higher than or equal to the bottom face of the magnetic member 12.

The diaphragm 19 is made of a resin material, PEN, which is a non-magnetic material, as in Example 1, and the suspension 11 is made of permalloy which is a magnetic material.

An operation of the aforementioned electromagnetic transducer 1100 will be described below.

In an initial state where no current flows through the coil 4, a magnetic path is formed by the magnet 25, the thin magnetic plate 15, the magnetic member 12, the center pole 13 and the yoke 6. As a result, an attraction force is generated on the magnetic member 12. If an alternating current flows through the coil 4, a driving force is generated on the magnetic member 12 in addition to the attraction force, so that the diaphragm 19 is vibrated.

In Example 2, the thin magnetic plate 15 is provided on the magnet 25. Therefore, magnetic flux in the magnetic path can be efficiently transmitted into the magnetic member 12, so that the magnetic resistance of the entire magnetic path can be reduced. Therefore, the magnetic flux density in the magnetic member 12 is large, so that the driving force generated on the magnetic member 12 is also large, thereby making it possible to improve a sound pressure.

Figure 9A:
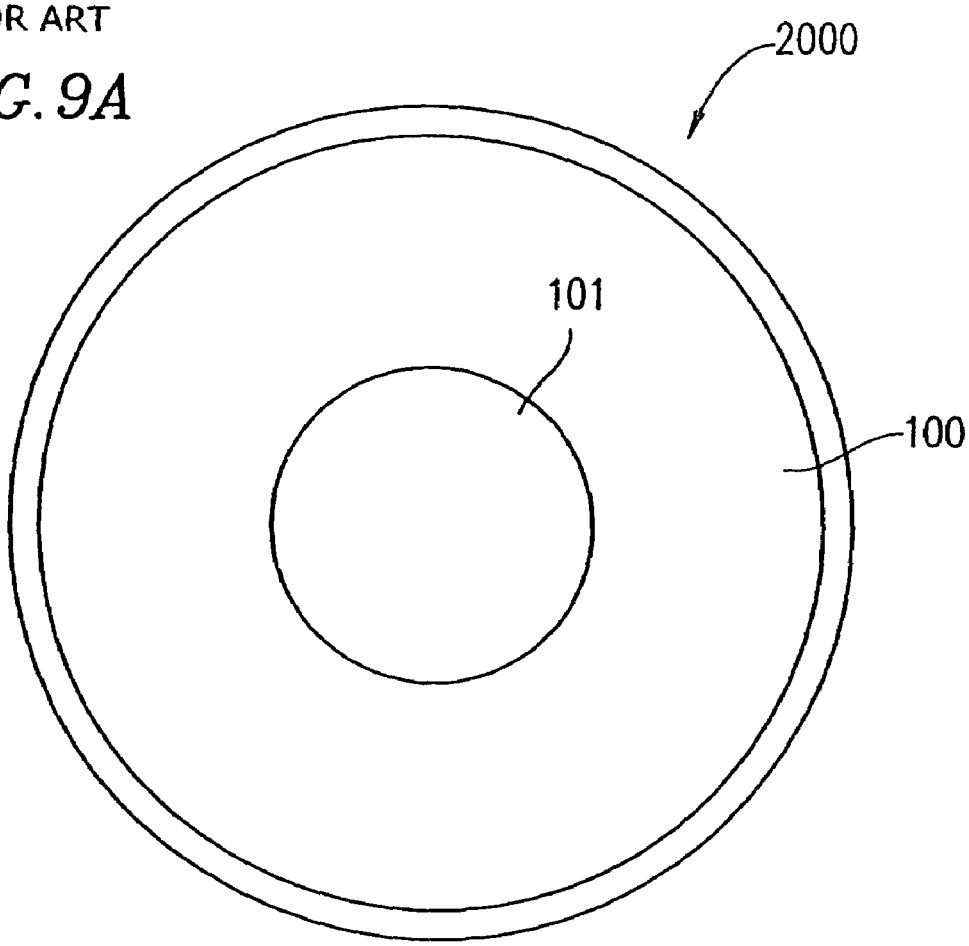
PRIOR ART FIG. 9A
FIGS. 9A and 9B are diagrams showing a conventional electromagnetic transducer.
Figure 9B:
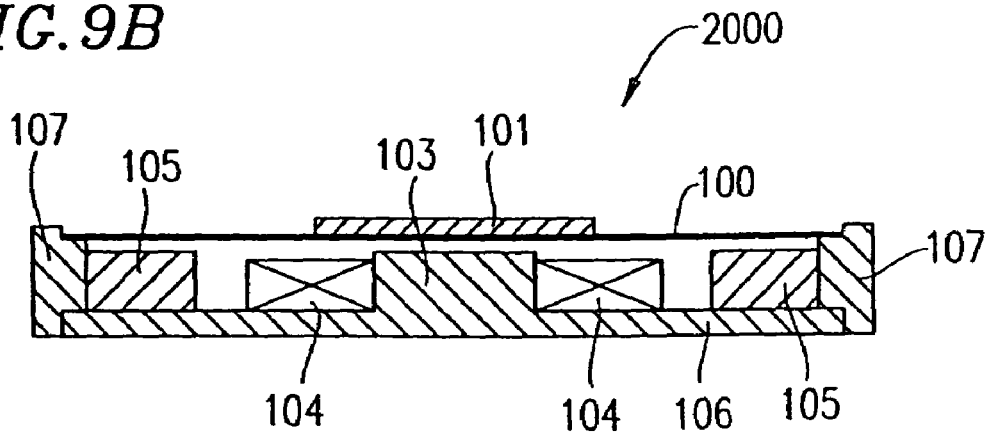
PRIOR ART FIG. 9B
Figure 10:
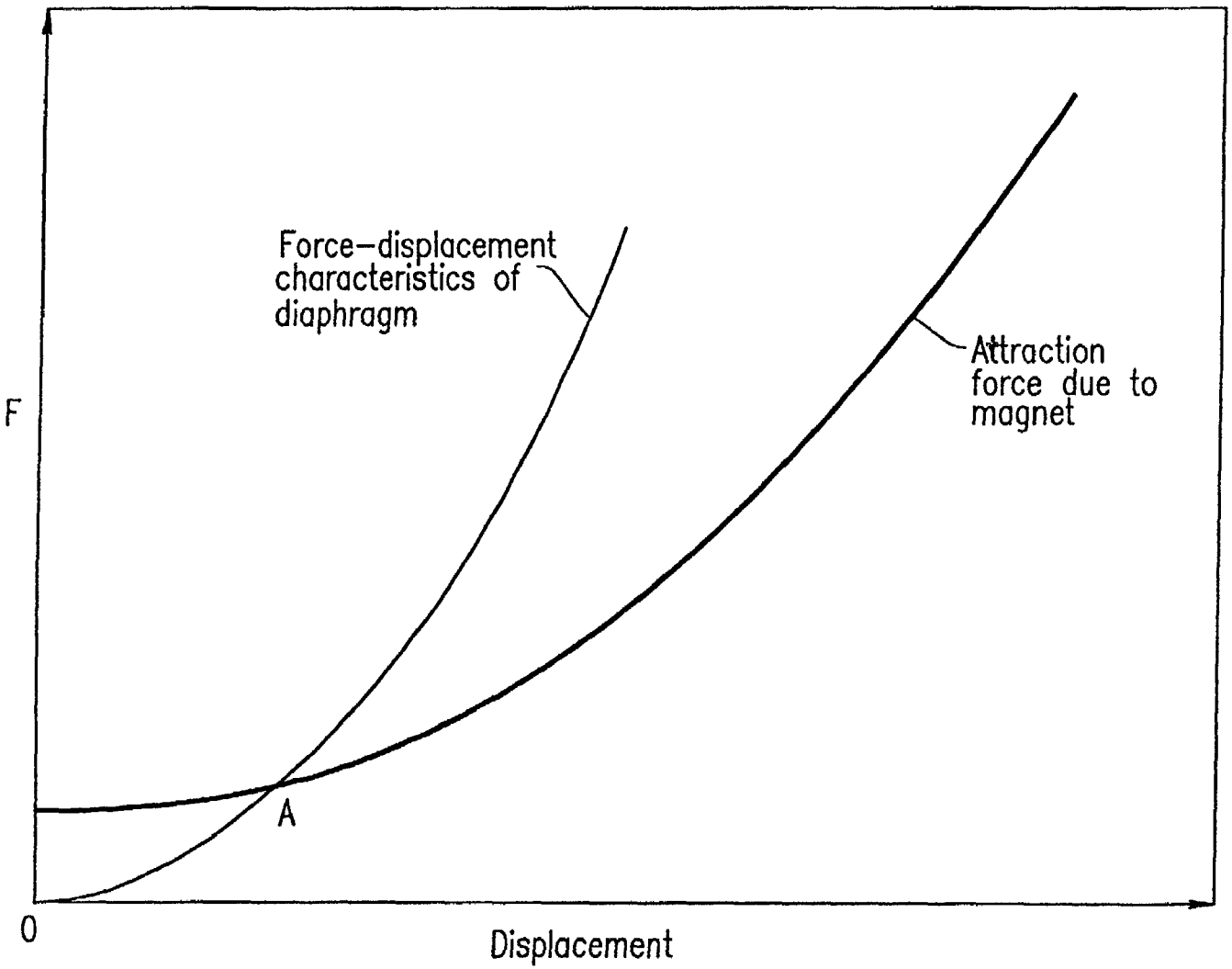
FIG. 10 is a diagram showing a force-displacement characteristics curve of a diaphragm, and an attraction force generated on a magnetic member by a magnet, in the conventional electromagnetic transducer of FIGS. 9A and 9B.

Further, in Example 2, the center pole 13 is positioned substantially as high as the magnetic member 12. Therefore, the magnetic member 12 is vibrated while the center pole 13 is passed through the center of the magnetic member 12. Since the center pole 13 and the magnetic member 12 are located on substantially the same plane, a magnetic gap between the magnetic member 12 and the center pole 13 is maintained to be narrow as compared to conventional apparatuses even when a gap between the magnet 25 and the magnetic member 12 is increased as the amplitude of vibration is increased. Therefore, the magnetic resistance of the entire magnetic path is small. Therefore, the driving force can be improved as compared to the conventional electromagnetic transducer 1100 of FIG. 9. As a result, it is possible to secure a driving force for a sufficient sound pressure, even when a gap between the magnet 25 and the magnetic member 12 is large so that the amplitude range can be increased. With the annular magnetic member 12, suspension 11 and diaphragm 19, the weight of the vibrating system can be light, so that a sound pressure can be increased.

In Example 2, the opening passing through the magnetic member 12, the suspension 11 and the diaphragm 19 is covered with the cover 20 so as to substantially completely block emission of sound from a gap between the center pole 13 and the magnetic member 12. However, when the emission of sound from the gap can be substantially blocked due to a relationship between the gap and the air hole 8, the cover 20 may not be required. Although in Example 2 the cover 20 is an independent part, the cover 20 may be integrated with the diaphragm 19.

In Example 2, the thin magnetic plate 15 is provided on the magnet 25. However, when a sufficient driving force is obtained only by a magnet, or when there is not sufficient space for the thin magnetic plate 15, the thin magnetic plate 15 may not be provided.

Although in Example 2 the diameter of the center pole 13 is constant as shown in FIG. 4, the diameter of the center pole 13 may be changed in a height direction. For example, when the diameter is decreased toward the yoke 6, the magnetic gap between the magnetic member 12 and the center pole 13 is increased as the magnetic member 12 is displaced downward. Therefore, a reduction in the driving force due to magnetic saturation of the magnetic member 12 can be suppressed.

EXAMPLE 3

An electromagnetic transducer 1200 according to Example 3 of the present invention will be described with reference to FIGS. 6 and 7.

Figure 6:
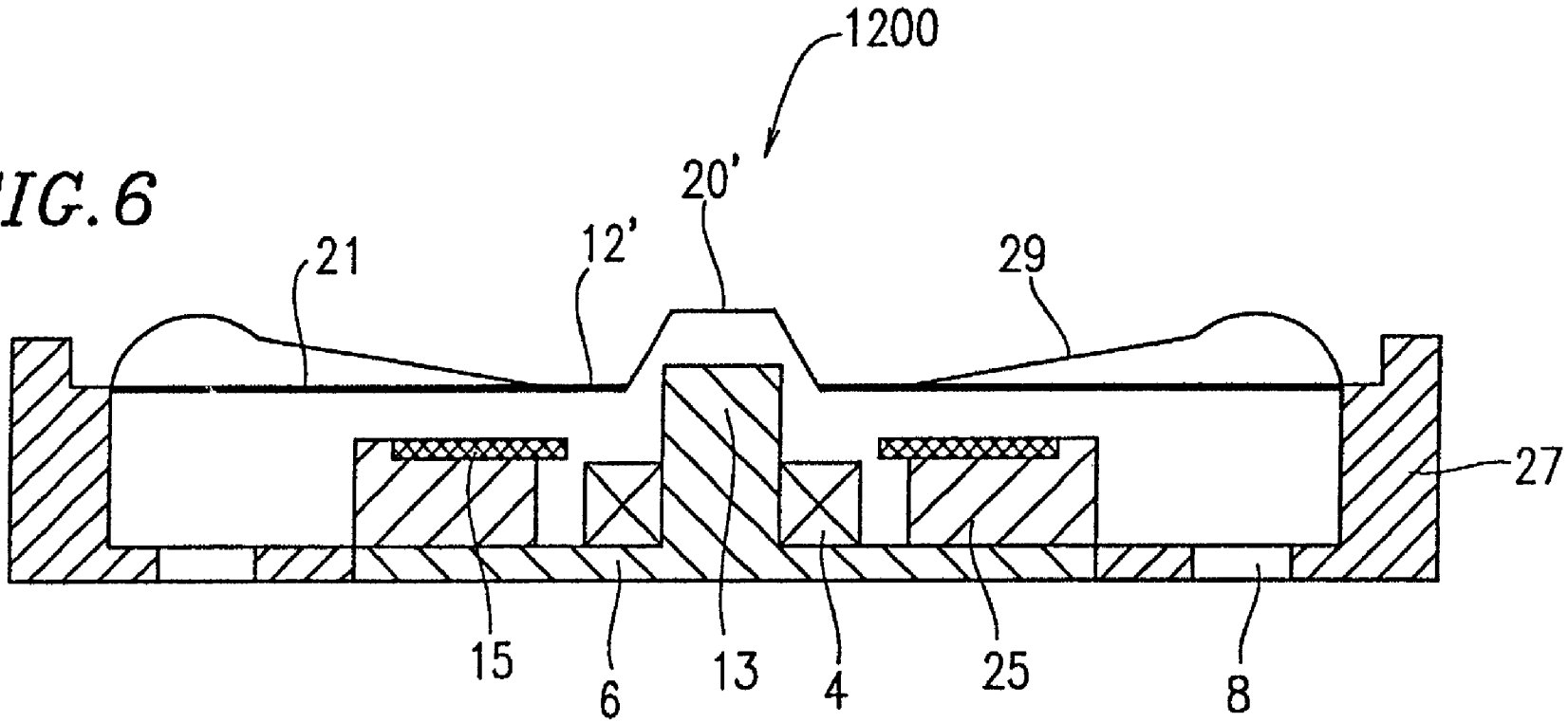
FIG. 6 is a diagram showing an electromagnetic transducer according to Example 3 of the present invention.

FIG. 6 is a cross-sectional view of the electromagnetic transducer 1200. A coil 4, a yoke 6, an air hole 8, a center pole 13, a thin magnetic plate 15 and a magnet 25 of the electromagnetic transducer 1200 are the same as those of the electromagnetic transducer 1100 of Example 2 in FIG. 4.

Figure 7:
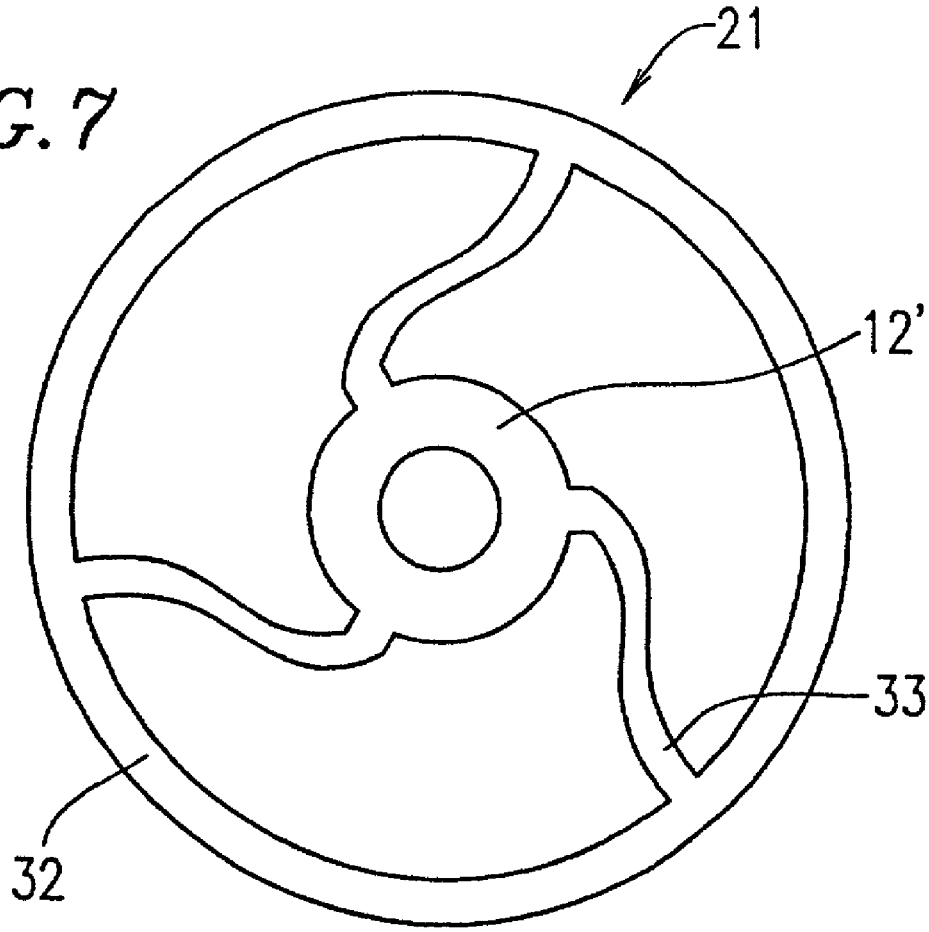
FIG. 7 is a diagram showing a suspension in the electromagnetic transducer of Example 3.

FIG. 7 is a plan view of a suspension 21 of the electromagnetic transducer 1200. Referring to FIGS. 6 and 7, the electromagnetic transducer 1200 further includes the suspension 21 into which a magnetic member 12' is integrated, a cylindrical housing 27 supporting the suspension 21 by its periphery, and a diaphragm 29 which is an integral part of the cover 20'. The outer periphery of the diaphragm 29 is substantially identical to that of the suspension 21, so that the outer periphery of the diaphragm 29 matches that of the suspension 21 on the same plane.

The diaphragm 29 is made of a resin material, PEN, as in Example 1 while the suspension 21 into which the magnetic member 12' is integrated is made of permalloy.

An operation of the aforementioned electromagnetic transducer 1200 will be described below.

In an initial state where no current flows through the coil 4, a magnetic path is formed by the magnet 25, the thin magnetic plate 15, the suspension 21, the center pole 13, and the yoke 6 as in Example 2. A vibrating operation of the electromagnetic transducer 1200 is the same as in Example 2.

The electromagnetic transducer 1200 of Example 3 differs from the electromagnetic transducer 1100 of Example 2 in that the magnetic member 12' is integrated with the suspension 21, and the diaphragm 29 is integrated with the cover 20', so that such integration allows for a decrease in the numbers of elements and fabrication steps and therefore manufacturing cost can be reduced. Such integration also leads to a reduction in variations in assembly and therefore variations in characteristics of a product can be minimized. Further, as shown in FIG. 7, the suspension 21 and the magnetic member 12' may be integrated into the same flat plate.

In the electromagnetic transducer 1200, the outer periphery of the diaphragm 29 is substantially identical to that of the suspension 21, so that the outer periphery of the diaphragm 29 matches that of the suspension 21 on the same plane. Therefore, it is easy to align the suspension 21 and the diaphragm 29, so that variations in assembly are reduced and therefore variations in characteristics of a product can be minimized.

EXAMPLE 4

As Example 4 of the present invention, a cellular phone 61 will be described with reference to FIGS. 8A and 8B, which is a portable communication device incorporating the electromagnetic transducer according to the present invention.

Figure 8A:
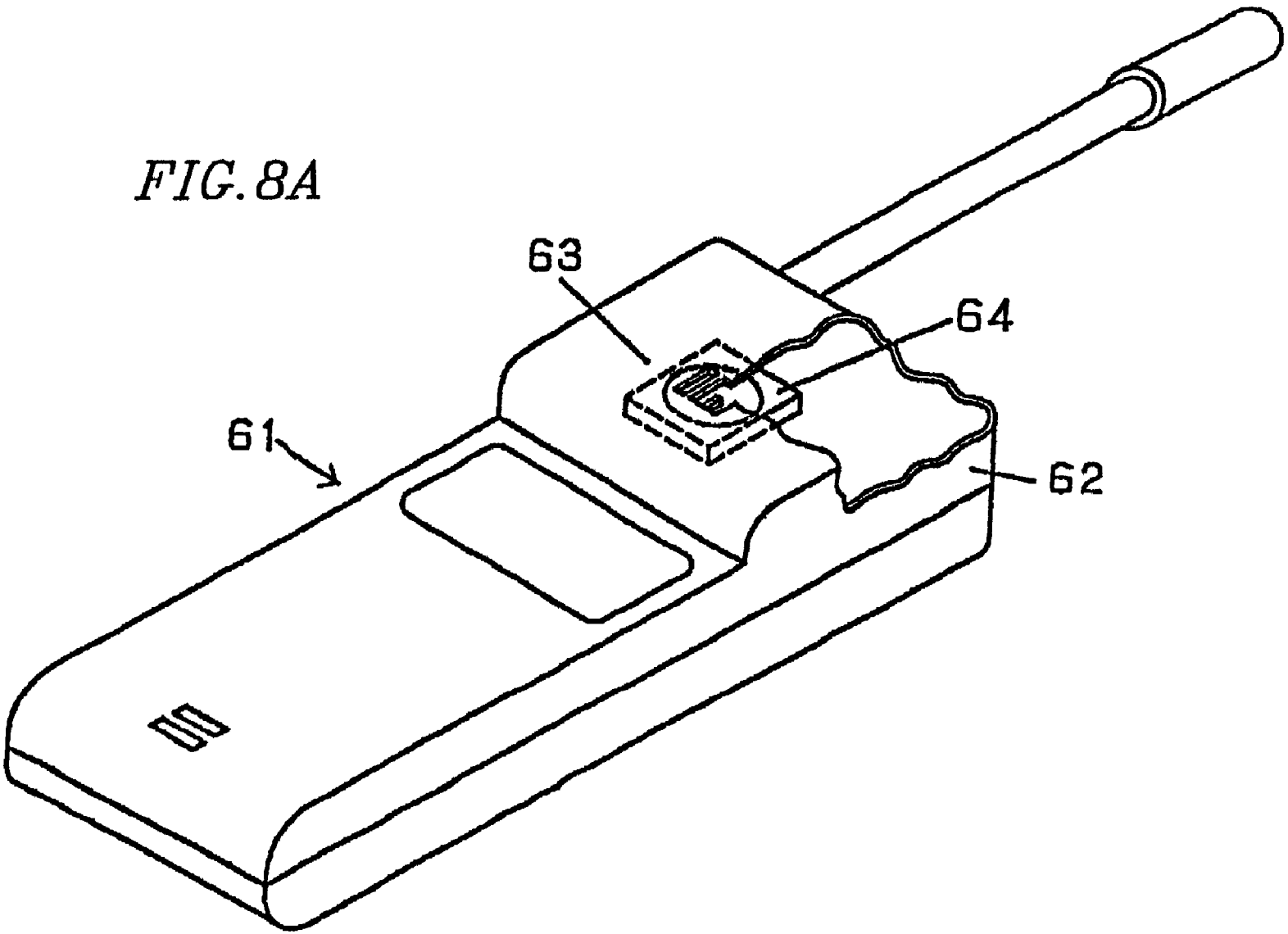
FIG. 8A is a diagram showing a portable communication terminal according to Example 4 of the present invention.

FIG. 8A is a partially-cutaway perspective view of the cellular phone 61 according to Example 4 of the present invention. FIG. 8B is a block diagram schematically illustrating the structure of the cellular phone 61.

The cellular phone 61 includes a housing 62, which has a sound hole 63, and an electromagnetic transducer 64. As the electromagnetic transducer 64 to be incorporated in the cellular phone 61, any one of the electromagnetic transducers 1000, 1100 and 1200 illustrated in Examples 1, 2 and 3 can be employed. The electromagnetic transducer 64 is disposed in such an orientation that its diaphragm opposes the sound hole 63.

Figure 8B:
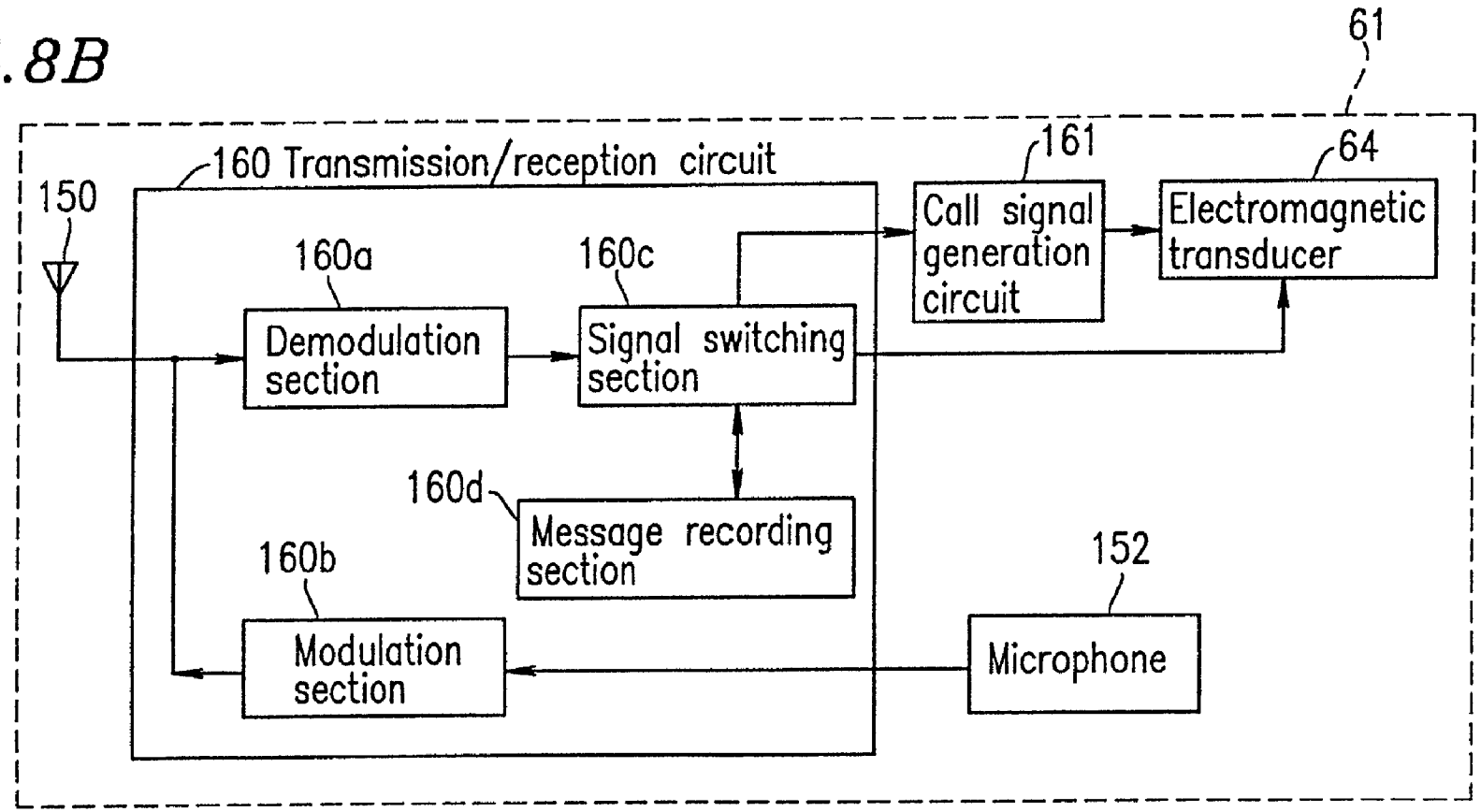
FIG. 8B is a block diagram showing an internal configuration of the portable communication terminal of FIG. 8A.

As shown in FIG. 8B, the cellular phone 61 further includes an antenna 150, a transmission/reception circuit 160, a call signal generation circuit 161, and a microphone 152. The transmission/reception circuit 160 includes a demodulation section 160*a*, a modulation section 160*b*, a signal switching section 160*c*, and a message recording section 160*d*.

The antenna 150 is used in order to receive radiowaves which are output from a nearby base station and to transmit radiowaves to the base station. The demodulation section 160*a* demodulates and converts a modulated signal which has been input via the antenna 150 into a received signal, and outputs the received signal to the signal switching section 160*c*. The signal switching section 160*c* is a circuit which switches between different signal processes depending on the contents of the received signal. If the received signal is a signal indicative of a received call (hereinafter referred to as a "call received" signal), the received signal is output to the call signal generation circuit 161. If the received signal is a voice signal, it is output to the electromagnetic transducer 64. If the received signal is a voice signal for message recording, the received signal is output to the message recording section 160*d*. The message recording section 160*d* is composed of a semiconductor memory (not shown), for example. Any recorded message which is left while the cellular phone 61 is ON is stored in the message recording section 160*d*. Any recorded message which is left while the cellular phone 61 is out of serviced areas or while the cellular phone 61 is OFF is stored in a memory device within the base station. The call signal generation circuit 161 generates a call signal, which is output to the electromagnetic transducer 64.

As is the case with conventional cellular phones, the cellular phone 61 includes a small microphone 152 as an electromagnetic transducer. The modulation section 160*b* modulates a dial signal and/or a voice signal which has been transduced by the microphone 152 and outputs the modulated signal to the antenna 150.

Now, an operation of the cellular phone 61 as a portable communication device having the above structure will be described.

The radiowaves which are output from the base station are received by the antenna 150, and are demodulated by the demodulation section 160*a* into a base-band received signal. Upon determination that the received signal is a call received signal, the signal switching circuit 160*c* outputs a signal indicative of a received call to the call signal generation circuit 161 in order to inform the user of the cellular phone 61 of the received call.

Upon receiving a call received signal, the call signal generation circuit 161 outputs a call signal. The call signal includes a signal corresponding to a pure tone in the audible range or a complex sound composed of such pure tones. When the signal is input to the electromagnetic transducer 64, the electromagnetic transducer 64 outputs a ringing tone to the user.

Once the user enters a talk mode, the signal switching circuit 160*c* performs a level adjustment of the received signal, and thereafter outputs the received voice signal directly to the electromagnetic transducer 64. The electromagnetic transducer 64 operates as a receiver or a loudspeaker to reproduce the voice signal.

The voice of the user is detected by the microphone 152 and converted into a voice signal, which is input to the modulation section 160*b*. The voice signal is modulated by the modulation section 160*b* onto a predetermined carrier wave, which is output via the antenna 150.

If the user has set the cellular phone 61 in a message recording mode and leaves the cellular phone 61 ON, any recorded message that is left by a caller will be stored in the message recording section 160*d*. If the user has turned the cellular phone 61 OFF, any recorded message that is left by a caller will be temporarily stored in the base station. As the user requests reproduction of the recorded message via a key operation, the signal switching circuit 160*c* receives such a request, and retrieves the recorded message from the message recording section 160*d* or from the base station. The voice signal is adjusted to an amplified level and output to the electromagnetic transducer 64. Then, the electromagnetic transducer 64 operates as a receiver or a loudspeaker to reproduce the recorded message.

Many electromagnetic transducers incorporated in portable communication devices, such as conventional cellular phones, have a high minimum resonance frequency, and are therefore only used for reproducing a ringing tone.

However, the electromagnetic transducer according to the present invention can have a low minimum resonance frequency. When incorporated in a portable communication device, the electromagnetic transducer according to the present invention can also be used for reproducing a voice signal, so that both a ringing tone and a voice signal can be reproduced by the same electromagnetic transducer. Thus, the number of acoustic elements to be incorporated in the portable communication device can be effectively reduced.

In the illustrated cellular phone 61, the electromagnetic transducer 64 is mounted directly on the housing 62. However, the electromagnetic transducer 64 may be mounted on a circuit board which is internalized in the cellular phone 61. An acoustic port for increasing the sound pressure level of the ringing tone may be additionally included.

Further, although in the electromagnetic transducer 64, the diaphragm is opposed to the sound hole, the yoke may be opposed to the sound hole.

Although a cellular phone is illustrated in FIGS. 8A and 8B as a portable communication device, the present invention is applicable to any portable communication device that incorporates an electromagnetic transducer, such as a pager, a notebook-type personal computer, a PDA or a watch.

The electromagnetic transducer of the present invention includes a magnetic member, a suspension supporting and fixing the magnetic member at its central portion, and a diaphragm connected to the suspension. As is different from conventional electromagnetic transducers, the magnetic member is supported by the suspension, the diaphragm does not need to support the magnetic member. Therefore, the shape of the diaphragm can be freely designed so as to obtain a satisfactory acoustic characteristic. Further, the elastic constant of the diaphragm can be reduced so that a low frequency signal, such as an audio signal, can be reproduced. In addition, distortion of the diaphragm can be reduced, and the flatness of the sound pressure-frequency characteristics of the diaphragm can be improved.

Further, according to the electromagnetic transducer of the present invention, the suspension supporting the magnetic member is made of metal material, such as stainless steel. Therefore, an electromagnetic transducer having a durability which substantially does not change over time can be realized. Since the suspension supports the magnetic member, an electromagnetic transducer capable of obtaining a satisfactory acoustic characteristic and reliability can be provided.

Further, according to the electromagnetic transducer of the present invention, the thin magnetic plate is provided between the magnet and the diaphragm, so that magnetic flux can be efficiently transmitted into the magnetic member, resulting in a large driving force. Therefore, sound pressure can be large.

Furthermore, according to the electromagnetic transducer, the magnetic member and the suspension each have an opening at a central portion thereof, and the center pole is passed through the openings, so that it is possible to reduce a gap between the magnetic member and the center pole forming a magnetic path. As a result, a driving force sufficient to largely vibrate the diaphragm can be obtained, thereby making it possible to reproduce a high sound pressure.

The portable communication device of the present invention includes the electromagnetic transducer of the present invention. Therefore, a single electromagnetic transducer can reproduce an alarm sound or melody sound, and voice. As a result, the number of acoustic transducers, a plurality of which are generally included in conventional portable communication terminals, can be reduced.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An electromagnetic transducer, comprising:

a magnetic member;

a suspension for supporting the magnetic member at a central portion of the suspension;

a diaphragm connected to the suspension at a central portion of the diaphragm;

a magnet for generating magnetic flux on the magnetic member; and a coil for generating alternating magnetic flux on the magnetic member.

2. An electromagnetic transducer according to claim 1, wherein the stiffness of the suspension is greater than the stiffness of the diaphragm with respect to a vibration direction.

3. An electromagnetic transducer according to claim 1, further comprising:

a center pole provided at an inner periphery side of the coil; and a yoke provided at a side of the coil opposite to the diaphragm, wherein the magnet surrounds the coil.

4. An electromagnetic transducer according to claim 1, wherein the diaphragm comprises a resin.

5. An electromagnetic transducer according to claim 1, wherein the suspension comprises a metal.

6. An electromagnetic transducer according to claim 1, wherein the suspension comprises a non-magnetic material.

7. An electromagnetic transducer according to claim 1, further comprising a thin magnetic plate provided between the magnet and the diaphragm.

8. An electromagnetic transducer according to claim 1, wherein an opening is provided at a central portion of the magnetic member.

9. An electromagnetic transducer according to claim 8, further comprising a cover for covering the opening.

10. An electromagnetic transducer, comprising:

a magnetic member;

a suspension for supporting the magnetic member at a central portion of the suspension;

a diaphragm connected to the suspension;

a yoke opposed to the diaphragm;

a center pole provided at a diaphragm side of the yoke;

a coil surrounding the center pole; and a magnet surrounding the coil, wherein an opening is provided in each of the magnetic member and the suspension, the center pole is shaped so as to be inserted into the openings, and an upper face of the center pole is positioned higher than or equal to a bottom face of the magnetic member.

11. An electromagnetic transducer according to claim 1, wherein the suspension and the magnetic member are integrated together.

12. An electromagnetic transducer according to claim 1, wherein an outer periphery of the diaphragm and an outer periphery of the suspension are positioned on the same plane.

13. A portable communication device comprising an electromagnetic transducer according to claim 1.

14. A portable communication device comprising an electromagnetic transducer according to claim 10.

* * * * *

UNITED STATES PATENT AND TRADEMARK OFFICE

CERTIFICATE OF CORRECTION

PATENT NO. : 7,187,779 B2
APPLICATION NO. : 09/965966
DATED : March 6, 2007
INVENTOR(S) : Usuki et al.

It is certified that error appears in the above-identified patent and that said Letters Patent is hereby corrected as shown below:

On the Title Page, Item (56) References Cited, FOREIGN PATENT DOCUMENTS, "JP 11-557794" should be --JP 11-55794--.

Signed and Sealed this

Thirty-first Day of July, 2007

JON W. DUDAS
*Director of the United States Patent and Trademark Office*